US005707301A

United States Patent [19]

Tollin

[11] Patent Number: 5,707,301

[45] Date of Patent: Jan. 13, 1998

[54] GOLF ALIGNMENT AID

[76] Inventor: Donald A. Tollin, 8524 N.W. 2nd St., Coral Springs, Fla. 33071

[21] Appl. No.: 779,502

[22] Filed: Jan. 7, 1997

[51] Int. Cl.[6] ..... A63B 69/36

[52] U.S. Cl. ..... 473/257; 473/252

[58] Field of Search ..... 473/218, 272, 473/238, 257

[56] References Cited

U.S. PATENT DOCUMENTS

| | | | |
|---|---|---|---|
| 3,550,946 | 12/1970 | Menendez | 473/218 |
| 4,563,010 | 1/1986 | McDorman et al. . | |
| 4,784,393 | 11/1988 | Williams et al. . | |
| 5,110,132 | 5/1992 | Weston et al. | 473/272 |
| 5,246,234 | 9/1993 | Zambelli . | |
| 5,322,288 | 6/1994 | Amis . | |
| 5,362,060 | 11/1994 | Hinson . | |
| 5,411,266 | 5/1995 | Guthry | 473/218 |
| 5,415,407 | 5/1995 | Beatty . | |
| 5,464,220 | 11/1995 | Hansen et al. . | |

*Primary Examiner*—George J. Marlo
*Attorney, Agent, or Firm*—Malin, Haley, DiMaggio & Crosby, P.A.

[57] ABSTRACT

A golf practice device, for placement on the turf directly in front of a golfer, including: a first alignment member for indicating proper stance alignment relative to the target line; a second alignment member, parallel to the first alignment member, for indicating swing path alignment relative to the target line; and third and forth members pivotally interconnecting said first and second members thereby forming an adjustable parallelogram structure. Each member defines an aperture sized for receiving either a conventional golf tee, or a rubber driving range type tee, therein such that the golfer is able to tee a golf ball thereon. Markings, in inches, originating at the golf tee aperture extend back along the back swing side of the ball for allowing the golfer to gauge the distance traveled by the club along the target line on the back swing. Furthermore, each member includes a concave depression and a sloped front end portion thereby enabling a golfer to putt a ball therefrom.

5 Claims, 5 Drawing Sheets

GOLF ALIGNMENT AID

BACKGROUND OF THE INVENTION

1. Field of the Invention

The present invention relates generally to golf teaching and practice devices, and more particularly to a golf alignment device for assisting a golfer in alignment of the golfer's stance and swing path relative to the target line.

2. Description of the Prior Art

The game of golf requires a golfer using a golf club to repeatedly strike a golf ball such that the ball travels town a target line toward a target which target is often hundreds of yards away. Proper execution of a golf shot requires that a golf ball be struck with the club face square to (i.e. directly facing) the target with the club head traveling along the target line at the moment of impact. Any deviation in either the club face alignment or swing path produces a proportioned deviation in the ball's trajectory thereby causing the ball to deviate from the target line. A common contributing cause of deviations in either club face alignment or swing path results when a golfer assumes a stance that is not aligned parallel to the target line and the golfer's subconscious mind recognizes the misalignment and causes a subconscious attempt to compensate by altering various swing mechanics thereby resulting in an inconsistent swing.

Accordingly, it is important for a golfer to properly position his body relative to the target line by assuming a proper stance parallel thereto. Furthermore, it is important for the golfer to execute a proper swing along a swing path having an impact point on the target line with the club face square with respect to the target line and with the club head moving down the target line at the moment of impact.

Another important aspect of the game of golf includes the art of putting. Putting involves striking the ball such that the ball rolls toward and into a cup on a part of the course referred to as the green. The significance of accurate putting is realized when one considers that fully one-half of a golfer's strokes may comprise putts. For example, golf courses are typically designed such a golfer completing a round in regulation will score a par 72 having been allotted two putts per hole for a total of 36 putts for an 18 hole round. According to that scenario putts account for fifty percent of the golfer's strokes. Accurate putting requires that the golfer swing the putter with a pendulum type stroke along a target line such that the ball is struck with the putter face square to the target line. In addition, distance is critical in putting. For example, if the ball is not holed on a given putt, it is desirable to have the ball come to rest within a few feet of the hole. Accordingly, it is important for the golfer to develop a reliable putting stroke that produces both alignment accuracy as well as proper speed. The most important swing mechanic associated with obtaining desired putting speed involves the length of the putting back stroke—long putts require the golfer to draw the putter back a greater distance than short putts.

A number of devices are known in the prior art for assisting a golfer in establishing a proper stance and aligning the golfer's self with the target line.

U.S. Pat. No. 4,563,010 issued to McDorman et al. discloses a training a device for golfers to assist in assuming a consistent stance when addressing the ball. However, in order to actually strike a ball while using the device McDorman requires that a club facer assembly be removed from the impact zone. To accomplish this task, McDorman teaches a rather complex, springloaded mechanism.

U.S. Pat. No. 4,784,393 issued to Williams et al. discloses a golf swing training device. However, the Williams device does not include a swing path alignment member and further requires that an end portion (25) be pivoted back away from a golf ball prior to striking.

U.S. Pat. No. 5,110,132 issued to Weston et al. discloses an alignment apparatus and method for golfers. Weston et al. disclose a series of members pivotally secured to form an alignment device that includes a pair of parallel members aligned with the stance line and the swing path respectively. An additional member is disposed perpendicular relative to the parallel members for serving as a reference point for the alignment of the ball to the golfers body. The Weston et al. device is pivotally connected such that the device may be collapsibly closed and transported in a golf bag. However, the Weston device includes a swing path member that is actually some distance inside the circumference of the golfer's swing part, and thus offset from the actual target line. Accordingly, the Weston device does not include a means for directly identifying the target line.

U.S. Pat. No. 5,246,234 issued to Zambili discloses a golf practice aid for assisting a golfer and maintaining proper stance about the golf ball and with respect to the target. The Zambili device also suffers from many of the disadvantages discussed above.

U.S. Pat. No. 5,322,288 issued to Amis discloses a golf stance alignment device for positioning on the ground between a golfer and a golf ball. The Amis device suffers from the same disadvantages discussed above; namely a first cross member 14 is not tangential with the point on the swing path at which the ball is struck.

U.S. Pat. No. 5,415,407 issued to Beatty, discloses a golf training method and device. The Beatty device does not overcome disadvantages present and the prior art references discussed above.

U.S. Pat. No. 5,464,220 issued to Hansen et al. discloses a golf practice device and method. The Hansen device includes a pair of parallel alignment members, however, as with the other prior art devices discussed herein, the neither of the alignment members are positioned directly on the target line.

Therefore, there exists a need for a golf alignment device that can be used while practicing and which provides an alignment means for the golfer's stance and target line, and which further has a target line alignment member positioned directly on the target line and which enables the golfer to strike balls therefrom. In addition, there exists a need for a golf alignment device that can be used during putting practice to assist the golfer in drawing a putter back a precise distance and maintaining the putter along the target line while practicing actual putts.

SUMMARY OF THE INVENTION

The present invention comprises a golf practice device, for placement on the turf directly in front of a golfer, which device includes: a first alignment member for indicating swing path alignment relative to the target line; a second alignment member, parallel to the first alignment member, for indicating proper stance alignment relative to the target line; and third and forth members pivotally interconnecting said first and second members thereby forming an adjustable parallelogram structure.

The first and second alignment members each include markings thereon for providing feedback to the golfer with respect to the golfer's set-up and swing; said markings existing on both alignment members and being arranged in mirror image such that the invention is suitable for use by either right or left handed golfers. Thus, for a left handed golfer the first alignment member indicates proper stance alignment relative to the target line, and the second alignment member indicates swing path alignment relative to the target line, as a left handed golfer assumes a stance on the opposite side of the device from a right handed golfer.

Furthermore, each alignment member includes a plurality of apertures therein. A pair of apertures are defined therein for receiving anchoring spikes for anchoring the device relative to the underlying turf. In addition, each member includes an aperture sized for receiving either a conventional golf tee, or a rubber driving range type tee, therein such that the golfer is able to tee a golf ball thereon. Markings, in inches, originating at the golf tee aperture extend back along the back swing side of each member for allowing the golfer to gauge the distance traveled by the club along the target line on the back swing. Furthermore, each member includes a concave depression and a sloped front end portion thereby enabling a golfer to putt a ball off of the device.

Accordingly, the present invention provides a golf alignment aid which, when positioned and anchored on the ground and oriented along the target line, provides means for aligning a golfer's stance and swing path with respect to a distant target. The present invention provides an alignment member pointing directly at the target from which a golfer is able to strike golf balls while practicing. Likewise, the present invention provides a ramped putting platform from which balls may be putted.

Therefore is it an object of the present invention to provide a collapsible golf alignment aid for use by either right or left handed golfers while practicing.

It is a further object of the present invention to provide a golf alignment aid including a target alignment member from which a golfer may strike a teed golf ball.

Still another object of the present invention is to provide a golf alignment device having an alignment member, aligned with the target and tangential to the swing path at the point of impact.

Yet another object of the instant invention is to provide a golf alignment member useful for putting practice from which a golfer may putt a golf ball.

In accordance with these and other objects which will become apparent hereinafter, the instant invention will now be described with particular reference to the accompanying drawings.

DESCRIPTION OF THE PREFERRED EMBODIMENTS

Figure 1:
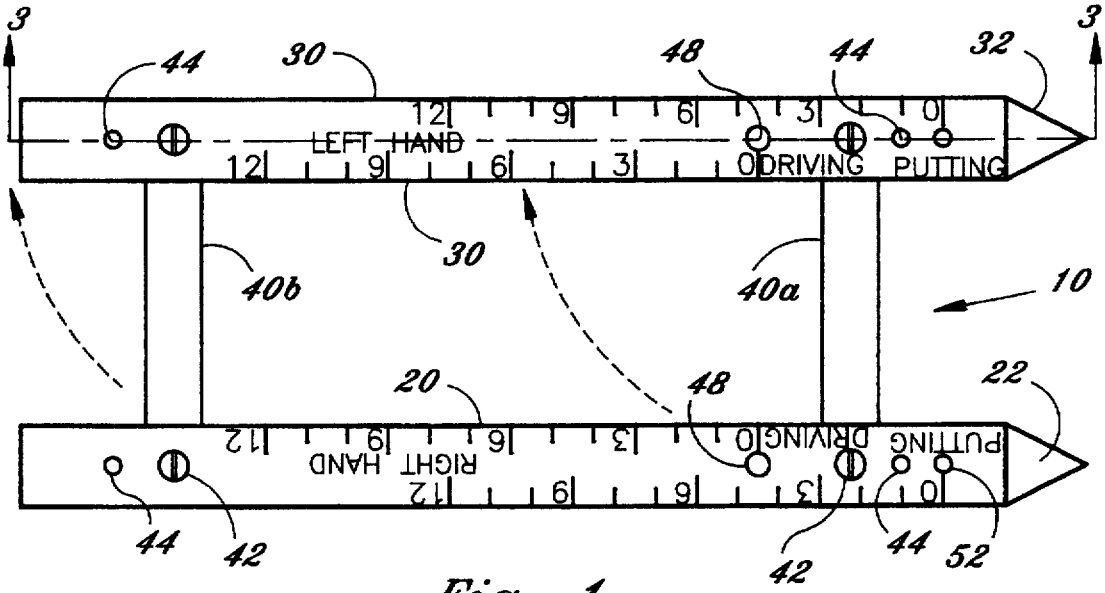
FIG. 1 is a plan view of the present invention in a use configuration.
Figure 2:
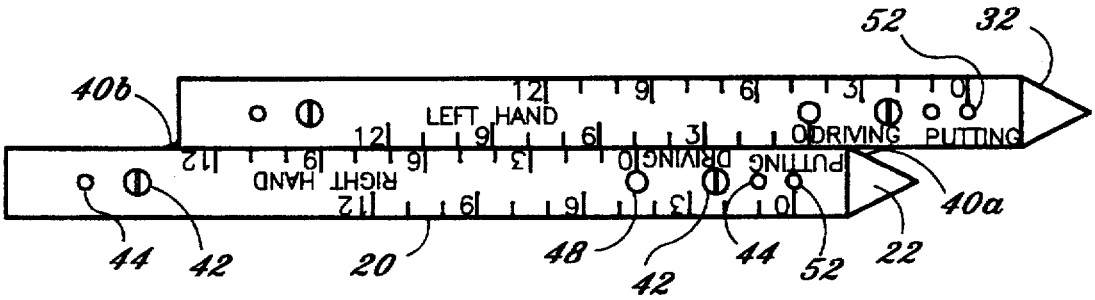
FIG. 2 is a plan view of the present invention in a collapsed configuration.

With reference now to FIGS. 1–8 there is depicted a golf alignment aid device, generally referenced as 10, for use by a golfer while practicing. The alignment device 10 includes a first alignment member 20, a second alignment member 30, and third and fourth members, 40*a* and 40*b* respectively, pivotally interconnecting first member 20 and second member 30. Accordingly, alignment aid 10 is pivotally movable from an expanded use configuration as depicted in FIG. 1, to a collapsed storage configuration as depicted in FIG. 2. As is apparent, the alignment aid 10 assumes a compact shape that is easily transported and stored when in the collapsed configurations, and may be carried in a golf bag for convenience of use.

Figure 3:
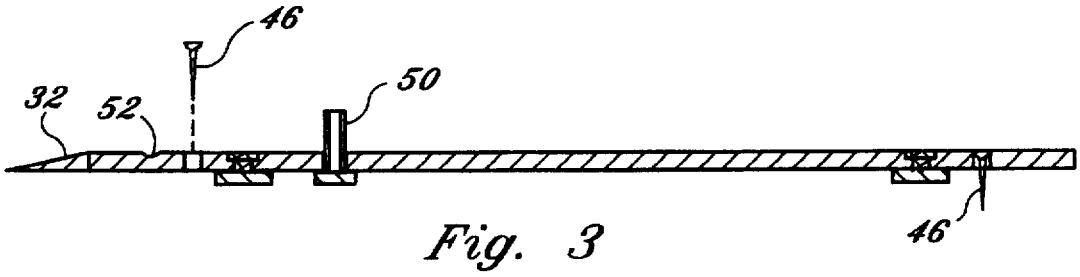
FIG. 3 is an elevational view of the present invention in partial section along the section line 3—3 in FIG. 1.

As further seen in FIGS. 1 and 2, first and second alignment members 20 and 30 each comprise elongate strips of impact resistant material having cross-sectional dimensions of approximately 2"×3/16", and an overall longitudinal length of 24"–26"; however, any suitable dimensions are within the scope of the invention. Each alignment member includes a pointed end portion, generally referenced as 22 and 32 respectively. Member end portions 22 and 32 define a triangular cross section forming a sloped top surface as best depicted in FIG. 3, for reasons that will soon become apparent.

Members 20, 30, 40*a* and 40*b* each define fastener receiving apertures for receiving fasteners 42 therethrough such that the alignment aid device comprises a series of pivotally connected members forming an adjustable parallelogram. In the preferred embodiment, interconnecting members 40*a* and 40*b* are sized in length such that alignment members 20 and 30 are in parallel spaced relation whereby the longitudinal axes of members 20 and 30 are separated by approximately 8", however, the inventor contemplates that the particular dimensions referenced herein may be generally altered as is desirable, and that such other dimensions fall within the scope of the invention.

Each alignment member, 20 and 30, further defines a pair of anchor receiving apertures 44 for receiving suitable anchoring devices 46 therethrough for anchoring the device to underlying turf when in use. In the preferred embodiment a suitable anchoring device comprises a spike received within an aperture 44 and having flush top, however, any suitable anchoring device is within the scope of the invention. Thus, when placed on underlying turf, spikes 46 are inserted through apertures 44 as shown in FIG. 3 thereby anchoring the device to the turf. In the alternative, spikes 46 may be demountably attached to members 20 and 30 such that placement of said members on the turf pauses spikes 46 to penetrate the turf.

Each alignment member further defines a golf tee receiving aperture 48. As best depicted in FIGS. 1–3, tee receiving aperture 48 is preferably defined along a longitudinal axis of each respective alignment member, and sized for insertion of a golf tee therethrough. In the preferred embodiment, tee receiving aperture 48 is defined between a respective alignment member pointed end portion and the center of the member—i.e. target side of center. Accordingly, when the device 10 is placed on a supporting turf surface, a golf tee 46 may be inserted in aperture 44 such that a golf ball may be supported thereon and struck therefrom. It is important to note that tee 46 receiving aperture 44 is sized to have an diameter of at least ⅝ such that a rubber golf tee, such as the type commonly found at commercial golf driving ranges, and shown in sectional view as 50 in FIG. 3, may be inserted therein. Thus, the device 10 is suitable for use at a commercial golf driving range where artificial turf surfaces provide the underlying supporting surface.

Each alignment member also defines a concave depression 52 on a top surface thereof. Depressions 52 are preferably relatively shallow and sized to function by maintaining a golf ball in position on an alignment member for putting practice purposes. Putting practice is further facilitated by a sloping end portion, 22 and 32 respectively, which sloping portion functions to transition a rolling golf ball from a top alignment member surface to the underling turf such that the roll of the putt remains true and unaffected. In the preferred embodiment depressions 52 are located proximate end portions 22 and 32 respectively so that a putted ball begins rolling on turf within a very short distance thereby maximizing the effects of rolling on turf as an actual putt.

Figure 4:
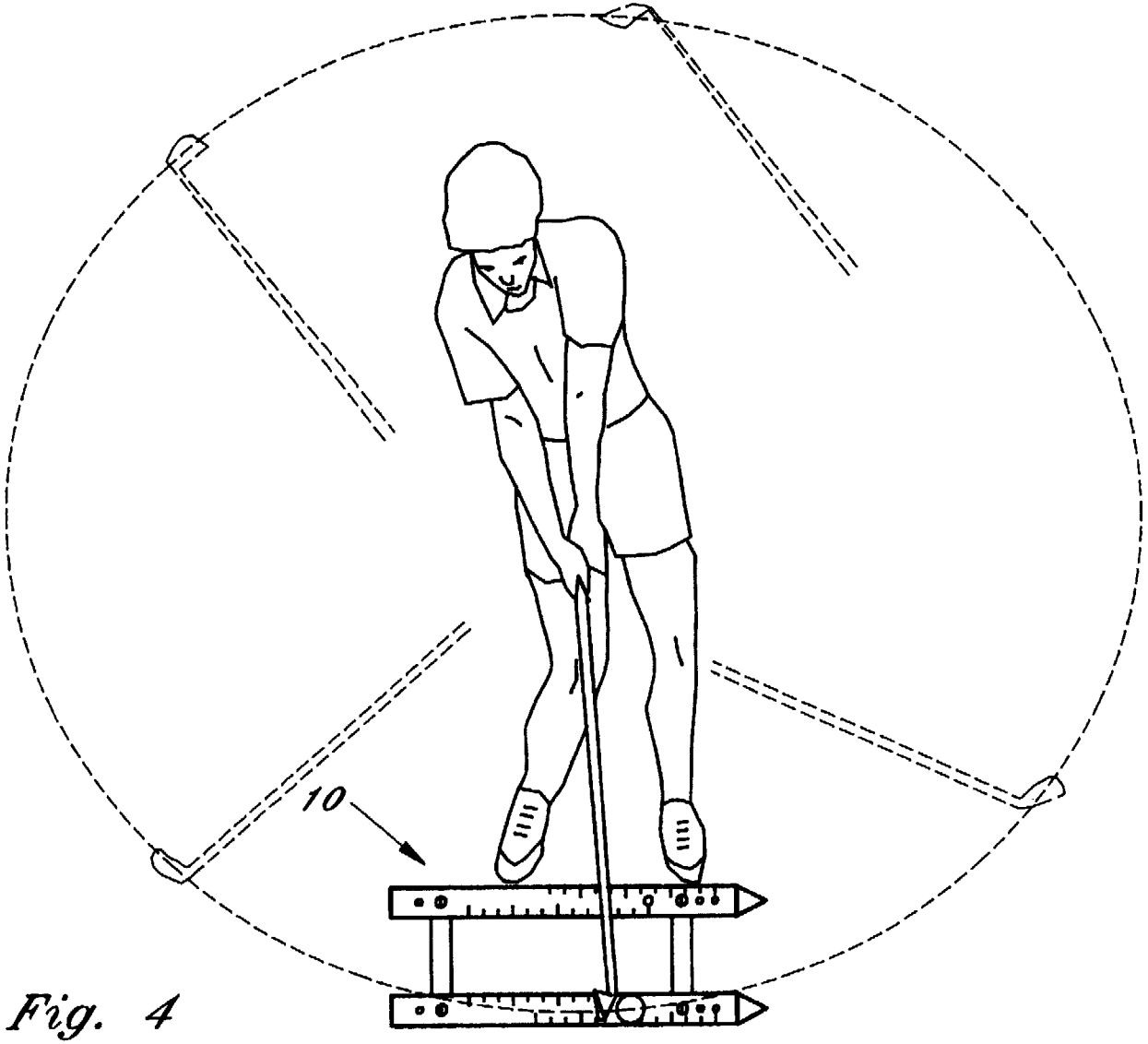
FIG. 4 is a perspective view of the present invention illustrating one mode (full swing) of use by a golfer.
Figure 6:
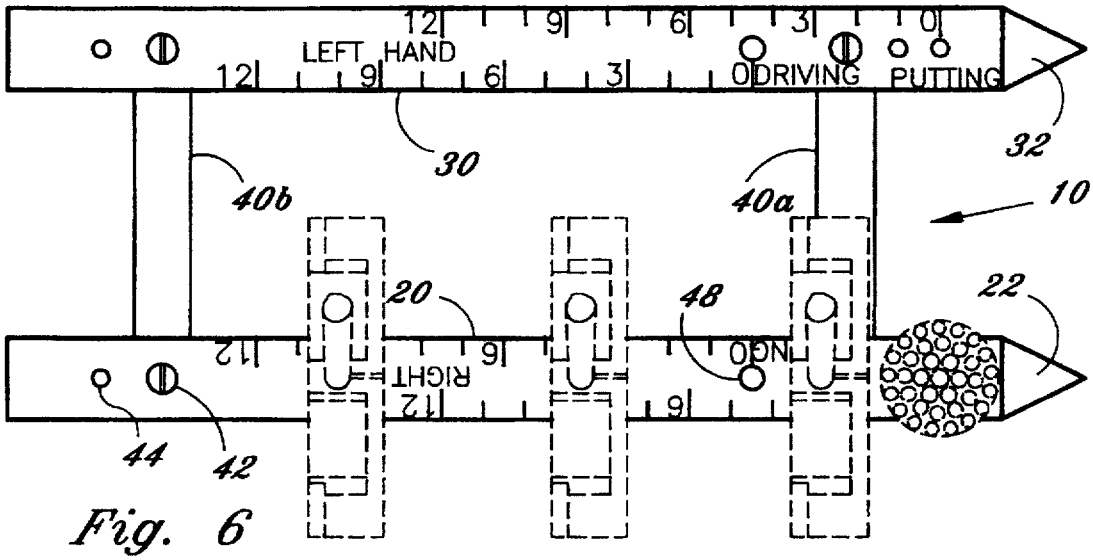
FIG. 6 is a plan view of the present invention in a second mode (putting) of use by a golfer.
Figure 7:
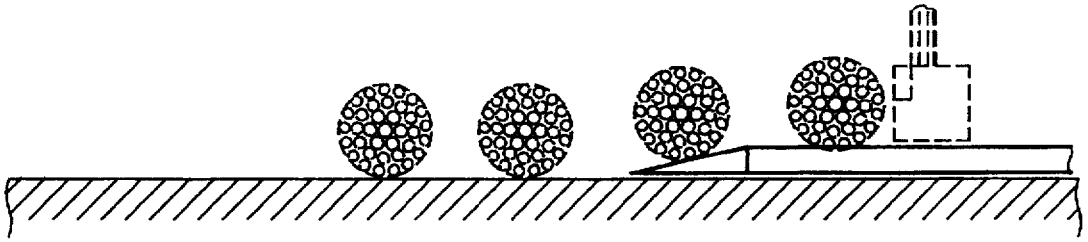
FIG. 7 is a partial elevational view of the present invention illustrating use in connection with putting.
Figure 8:
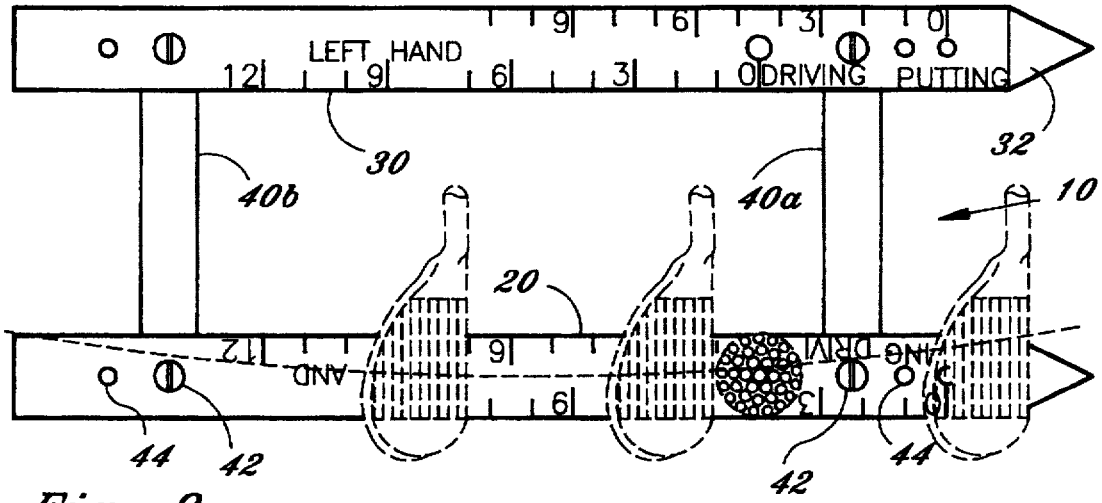
FIG. 8 is a plan view of the present invention illustrating use in connection with a full golf swing.

As briefly discussed above, each alignment member includes markings or indicia thereon as best depicted in FIGS. 1 and 2. In the preferred embodiment the markings indicate inches, and are located along the back swing path, from each two specific locations: tee receiving aperture 48; and putting depression 52. With respect to tee receiving aperture 48, the preferred embodiment contemplates markings from 0–12 inches, originating at aperture 48 and extending along the longitudinal axis of the alignment member for providing the golfer with reference information in connection with the back swing. For example, one accepted theory relating to the back swing teaches that it is desirable to initially draw the club head back along an extension of the target line. Accordingly, the markings provide the golfer with feedback relating to the distance that the club head is drawn back along an extension of the target line as depicted in FIGS. 4, 6, and 8. With respect to putting depressions 52, the preferred embodiment contemplates markings from 0–12 inches, originating at each depression 52 and extending along an extension of the target line. These markings provide the golfer with feedback relating to the distance that the putter head is drawn back along an extension of the target line as illustrated in FIG. 6. Since distance and the speed of the putt typically dictate the distance which the golfer will draw the putter head back along the target line, the putt markings provide feedback information for developing a reliable putting touch.

Figure 5A:
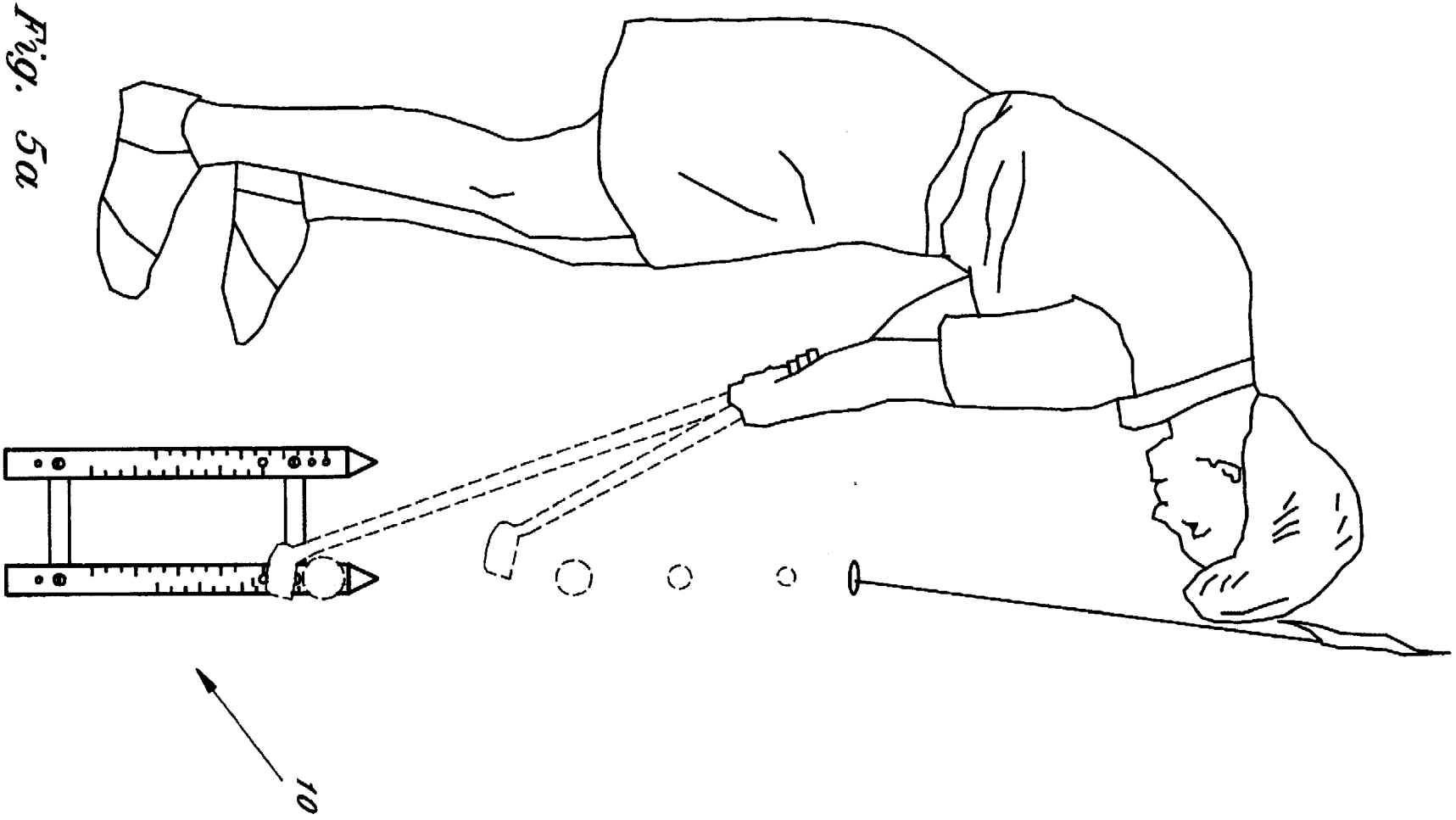
FIG. 5*a* is a perspective view of the present invention illustrating a second mode (putting) of use by a golfer.
Figure 5B:
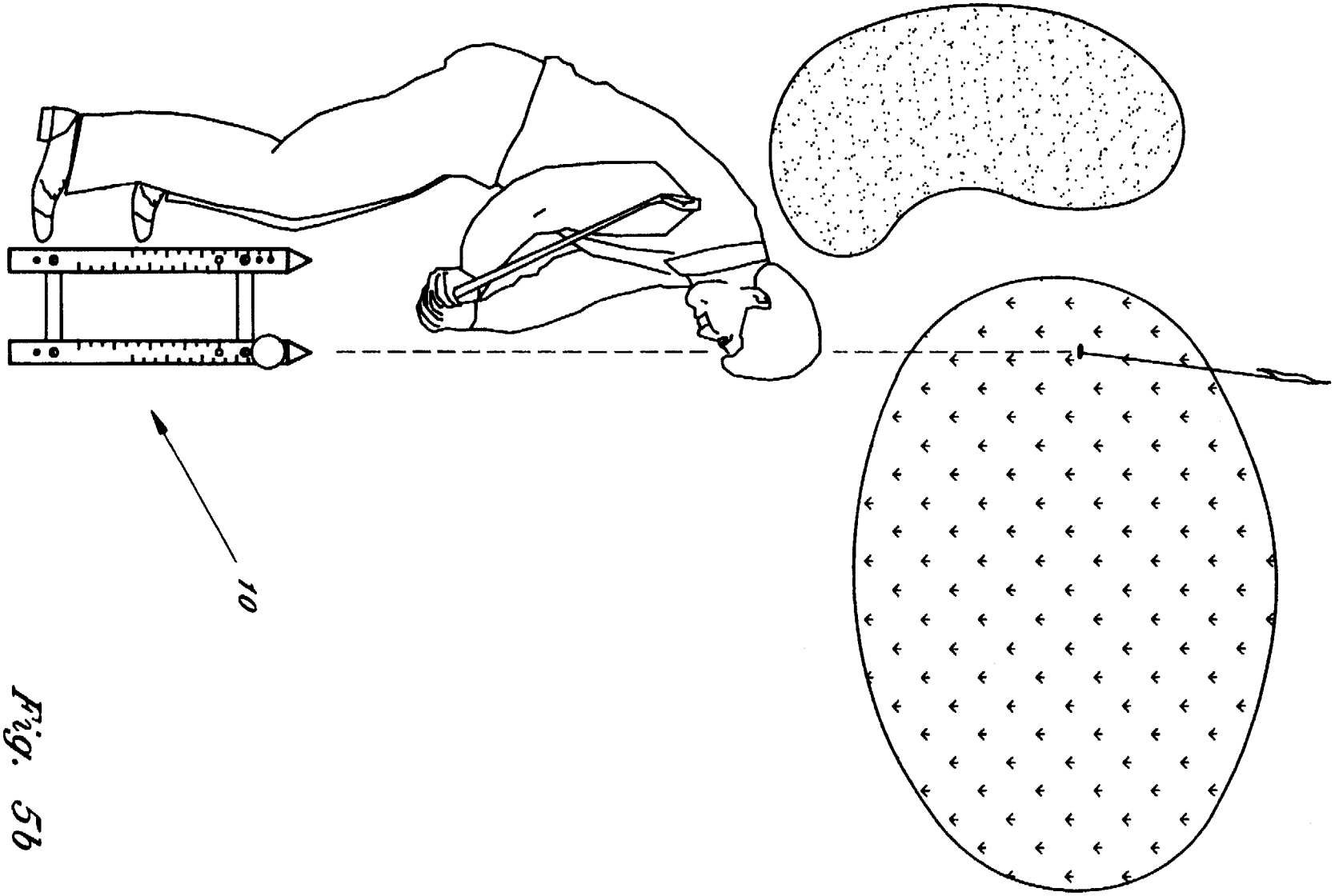
FIG. 5*b* is a perspective view of the present invention illustrating a first mode (full swing) of use by a golfer.

The instant invention is used by transporting the alignment device 10 to a practice location in its collapsed configuration as depicted in FIG. 2, and expanding the device to its expanded use configuration as depicted in FIG. 1. The device is then placed on the turf and (for a right handed golfer) member 20 is directly aligned with a distant target (e.g. flag, green etc.), see FIGS. 4, **5*a* and 5*b*. Next, anchoring spikes 46 are inserted through apertures 44 thereby anchoring the device along the target line. The golfer then inserts a suitable golf tee through aperture 48 at alignment member 20 and tees a golf ball thereon. As best depicted in FIG. 5*b*, the right handed golfer then places his feet such that a line running across the tips of his toes is parallel with member 30 thereby assuring that the golfer's body is properly aligned with respect to the target line. As is now apparent the golfer addresses the ball by setting the club face square with respect to the target line as indicated by member 20. See FIG. 8. The golfer then initiates a back swing, taking care to draw the club back a predetermined distance along the target line, and executes the shot by swinging along the target line at impact, as illustrated in FIG. 8 for a full swing and FIG. 6** for putting.

As is now apparent the markings existing on both alignment members and being arranged in mirror image such that the invention is suitable for use by right and left handed golfers. Thus, for a left handed golfer the second alignment member 30 indicates proper stance alignment relative to the target line, and the first alignment member 20 indicates swing path alignment relative to the target line.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A golf alignment and practice device comprising:

a first elongated alignment member;

a second elongated alignment member;

a third member pivotally connecting said first and second alignment members, and a fourth member spaced from said third member also pivotally connecting said first and second alignment members, said first, second, third, and fourth members forming a pivotally adjustable parallelogram;

said first and second alignment members each defining a pair of anchor receiving apertures;

said first and second alignment members each including an end portion having a downwardly sloped top surface;

said first and second alignment members each defining a golf tee aperture, whereby a golf tee inserted therein is used to support a golf ball thereon for a golfer to strike the ball therefrom.

2. A golf alignment and practice device according to claim 1, wherein:

said first and second alignment members each having a top surface defining a concave depression thereon and proximate said end portion.

3. A golf alignment and practice device according to claim 2, wherein each of said member end portion top surfaces converge to an apex formed at the longitudinal axis of each of said members.

4. A golf alignment and practice device according to claim 2, wherein each of said alignment members include a top surface portion having first and second sets of markings thereon, said first set of markings originating at said golf tee aperture and extending along a longitudinal axis of said member; said second set of markings originating at said concave depression and extending along said longitudinal axis of said member.

5. A golf alignment and practice device comprising:

a swing path alignment member;

a stance alignment member;

a third member pivotally interconnecting said swing path and said stance alignment members, and a fourth member spaced from said third member also pivotally interconnecting said swing path and said stance alignment members, said swing path, stance, third, and fourth members forming a pivotally adjustable parallelogram;

said swing path and said stance alignment members each defining a pair of anchor receiving apertures;

said swing path alignment member defining a golf tee aperture, whereby a golf tee inserted therein is used to support a golf ball thereon for a golfer to strike the ball therefrom;

said swing path alignment member further having a top surface defining a shallow concave depression, said top surface forming a downwardly sloping end portion;

said swing path alignment member further including a top surface portion having first and second sets of markings thereon, said first set of markings originating at said golf tee aperture and extending along a longitudinal axis of said member, said second set of markings originating at said concave depression and extending along said longitudinal axis of said member.

* * * * *